US012410526B2

(12) United States Patent
Perlade et al.

(10) Patent No.: US 12,410,526 B2
(45) Date of Patent: Sep. 9, 2025

(54) METHOD FOR MANUFACTURING AN ASSEMBLY

(71) Applicant: ArcelorMittal, Luxembourg (LU)

(72) Inventors: Astrid Perlade, Le Ban-Saint-Martin (FR); Céline Musik, Piblange (FR); Christine Kaczynski, Maizières-les-Metz (FR); Yacine Benlatreche, Metz (FR); Remi Cavallotti, Metz (FR)

(73) Assignee: ArcelorMittal, Luxembourg (LU)

( * ) Notice: Subject to any disclaimer, the term of this patent is extended or adjusted under 35 U.S.C. 154(b) by 662 days.

(21) Appl. No.: 17/616,629

(22) PCT Filed: Jun. 5, 2020

(86) PCT No.: PCT/IB2020/055293
§ 371 (c)(1),
(2) Date: Dec. 3, 2021

(87) PCT Pub. No.: WO2020/245773
PCT Pub. Date: Dec. 10, 2020

(65) Prior Publication Data

US 2022/0220618 A1 Jul. 14, 2022

(30) Foreign Application Priority Data

Jun. 5, 2019 (WO) ..... PCT/IB2019/054667

(51) Int. Cl.
*C22C 30/00* (2006.01)
*C22C 18/04* (2006.01)
(Continued)

(52) U.S. Cl.
CPC ..... *C23C 30/00* (2013.01); *C22C 18/04* (2013.01); *C22C 38/002* (2013.01); *C22C 38/02* (2013.01);
(Continued)

(58) Field of Classification Search
CPC ... C23C 28/021; C23C 28/023; C23C 28/025; C23C 30/00; C23C 14/02; C23C 14/06; C23C 14/16; C23C 14/22; C23C 28/02
See application file for complete search history.

(56) References Cited

U.S. PATENT DOCUMENTS

2008/0271823 A1* 11/2008 Hofmann ..... C22C 38/06 148/333
2017/0114467 A1* 4/2017 Chaleix ..... C23C 28/3225
(Continued)

FOREIGN PATENT DOCUMENTS

JP H02141588 A 5/1990
JP H05320875 A 12/1993
(Continued)

OTHER PUBLICATIONS

James D. Fritz, Effects of Metallurgical Variables on the Corrosion of Stainless Steels, Corrosion: Fundamentals, Testing, and Protection, vol. 13A, ASM Handbook, Edited By Stephen D. Cramer, Bernard S. Covino, Jr., ASM International, 2003, p. 266-274, https://doi.org/10.31399/asm.hb.v13a.a0003617 (Year: 2003).*
(Continued)

*Primary Examiner* — Nicholas A Wang
(74) *Attorney, Agent, or Firm* — Davidson Kappel LLC

(57) ABSTRACT

A pre-coated steel substrate coated with: a first pre-coating including titanium, the first coating having a thickness of 40 nm to 1200 nm, optionally, an intermediate pre-coating layer including at least 8% by weight nickel and at least 10% by weight chromium, the rest being iron or an intermediate pre-coating layer including Fe, Ni, Cr and Ti wherein the amount of Ti is above or equal to 5 wt. % and wherein the following equation is satisfied: 8 wt. %<Cr+Ti<40 wt. %, the balance being Fe and Ni, the intermediate pre-coating layer having a thickness between 2 and 30 nm a second
(Continued)

pre-coating being a zinc-based coating and the steel substrate including above 0.05 wt. % of Si.

25 Claims, 1 Drawing Sheet

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/50*** | (2006.01) |
| ***C22C 38/54*** | (2006.01) |
| ***C23C 28/02*** | (2006.01) |
| ***C23C 30/00*** | (2006.01) |

(52) U.S. Cl.
CPC ..... *C22C 38/06* (2013.01); *C22C 38/44* (2013.01); *C22C 38/46* (2013.01); *C22C 38/50* (2013.01); *C22C 38/54* (2013.01); *C23C 28/021* (2013.01); *C23C 28/025* (2013.01)

(56) References Cited

U.S. PATENT DOCUMENTS

| | | | |
|---|---|---|---|
| 2018/0274062 | A1 | 9/2018 | Allely et al. |
| 2019/0144963 | A1 | 5/2019 | Georges et al. |
| 2022/0186383 | A1* | 6/2022 | Stille ..... C22C 38/002 |

FOREIGN PATENT DOCUMENTS

| | | | |
|---|---|---|---|
| JP | 20180050699 | A | 5/2018 |
| JP | 1020180122731 | A | 11/2018 |
| WO | WO 2015/150850 | A1 | 10/2015 |
| WO | WO 2018/115946 | A1 | 6/2018 |
| WO | WO 2019/043472 | A1 | 3/2019 |
| WO | WO 2019/082037 | A1 | 5/2019 |

OTHER PUBLICATIONS

Marder, A.R. "The metallurgy of zinc-coated steel." 2000. Progress in materials science. 45. p. 191-271. (Year: 2000).*
Search Report of PCT/IB2020/055293 dated Jul. 15, 2020.
Written opinion for PCT/IB2020/055293.
*Critical LME Elongation : Un essai Gleeble pour évaluer la sensibilité au LME d'un acier revêtu soudé par points* », Journées Annuelles SF2M 2017, Oct. 23-25, 2017, JA0104, ArcelorMittal Research Maizières-lès- Metz, see machine translation and also specification of the present application.

* cited by examiner

METHOD FOR MANUFACTURING AN ASSEMBLY

The present invention relates to a pre-coated steel substrate, a method for the manufacture of the coated steel substrate; a method for the manufacture of an assembly and an assembly. It is particularly well suited for construction and automotive industries.

BACKGROUND

Zinc based coatings are generally used because they allow a protection against corrosion, thanks to barrier protection and cathodic protection. The barrier effect is obtained by the application of a metallic or non-metallic coating on steel surface. Thus, the coating prevents the contact between steel and a corrosive atmosphere. The barrier effect is independent from the nature of the coating and the substrate. On the contrary, sacrificial cathodic protection is based on the fact that zinc which is active metal as compared to steel as per EMF series. Thus, if corrosion occurs, zinc is consumed preferentially as compared to steel. Cathodic protection is essential in areas where steel is directly exposed to corrosive atmosphere, like cut edges where surrounding zinc consumes before the steel.

SUMMARY OF THE INVENTION

However, when heating steps are performed on such zinc coated steel sheets, for example during hot press hardening or resistance spot welding, cracks are observed in the steel which initiates from the steel/coating interface. Indeed, occasionally, there is a reduction of mechanical properties due to the presence of cracks in the coated steel sheet after the above operation. These cracks appear with the following conditions: high temperature above the melting point of coating materials; contact between the liquid metal having a low melting point (such as zinc) and the substrate in combination with the presence of critical stresses; diffusion and wetting of molten metal in the grain and grain boundaries of the steel substrate. The designation for such phenomenon is known as liquid metal embrittlement (LME), and also called liquid metal assisted cracking (LMAC).

An object of the present invention is to provide an assembly comprising at least a steel substrate which does not have LME issues. It aims to make available, in particular, an easy to implement method in order to obtain this assembly which does not have LME issues after the hot press forming and/or the welding.

The present invention provides a pre-coated steel substrate coated with:

- a first pre-coating comprising titanium, said first coating having a thickness of 40 nm to 1200 nm,
- optionally, an intermediate pre-coating layer comprising at least 8% by weight nickel and at least 10% by weight chromium, the rest being iron or an intermediate pre-coating layer comprising Fe, Ni, Cr and Ti wherein the amount of Ti is above or equal to 5 wt. % and wherein the following equation is satisfied: 8 wt. %<Cr+Ti<40 wt. %, the balance being Fe and Ni, the intermediate pre-coating layer having a thickness between 2 and 30 nm
- a second pre-coating being a zinc-based coating and
- said steel substrate comprising above 0.05 wt. % of Si.

BRIEF DESCRIPTION OF THE DRAWINGS

The invention will now be illustrated by means of indicative examples given for information purposes only, and without limitation, with reference made to the accompanying figures in which.

DETAILED DESCRIPTION

Figure 1:
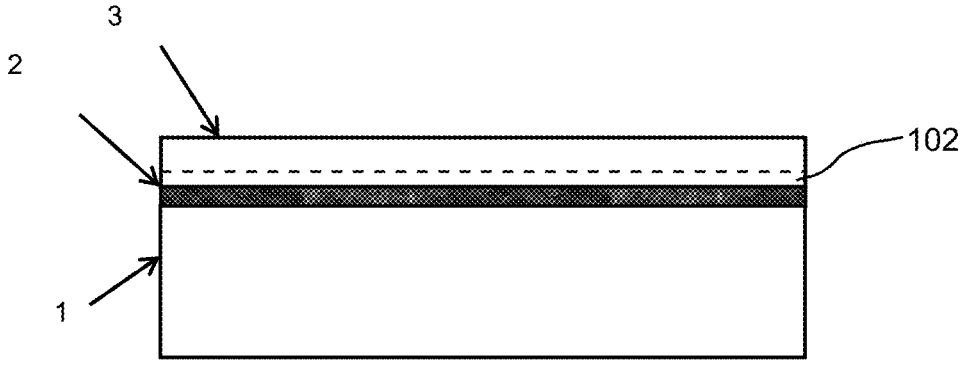
FIG. 1 schematically represents a pre-coated steel substrate according to the invention and FIG. 2 represents an assembly according to the present invention.

The designation "steel" or "steel sheet" means a steel sheet, a coil, a plate having a composition allowing the part to achieve a tensile strength up to 2500 MPa and more preferably up to 2000 MPa. For example, the tensile strength is above or equal to 500 MPa, preferably above or equal to 980 MPa, advantageously above or equal to 1180 MPa and even above or equal 1470 MPa.

The invention relates to a pre-coated steel substrate coated with:

- a first pre-coating comprising titanium, said first coating having a thickness of 40 nm to 1200 nm,
- optionally, an intermediate pre-coating layer comprising at least 8% by weight nickel and at least 10% by weight chromium, the rest being iron or an intermediate pre-coating comprising Fe, Ni, Cr and Ti wherein the amount of Ti is above or equal to 5 wt. % and wherein the following equation is satisfied: 8 wt. %<Cr+Ti<40 wt. %, the balance being Fe and Ni, the intermediate layer having a thickness of 2 nm to 30 nm,
- a second pre-coating layer being a zinc-based coating and said steel substrate comprising above 0.05 wt. % of Si.

Indeed, without willing to be bound by any theory, it is believed that during the welding, the molten Zn in the second pre-coating dissolves the steel until the coating becomes saturated in iron. In standard Zn-coated steel without the first pre-coating comprises Ti, it is observed that the critical embrittling phenomenon occurs after this first rapid dissolution, because of the preferential Zn diffusion in the steel grain boundaries, especially if steel contains Si, leading to a significant decrease of their cohesive strength. When a first pre-coating comprising titanium is present, precipitates enriched with Fe, Ti and Si are formed in the molten Zn, so that the saturation of the coating in iron is strongly retarded and dissolution can longer and deeper proceed, thus protecting the substrate from LME.

If the thickness of the first pre-coating comprising titanium is below 40 nm, there is a risk that the amount of titanium is not enough to form the precipitates in the molten coating during the whole duration of the critical welding operation so as to prevent LME. Adding more than 1200 nm does not bring additional benefits.

Preferably, the first pre-coating consists of titanium, i.e. the amount of titanium is above or equal to 99% by weight.

In a preferred embodiment, the first pre-coating has a thickness between 40 and 80 nm. In another preferred embodiment, the first pre-coating has a thickness between 80 and 150 nm. In another preferred embodiment, the first pre-coating has a thickness between 150 and 250 nm. In another preferred embodiment, the first pre-coating has a thickness between 250 and 450 nm. In another preferred embodiment, the first pre-coating has a thickness between 450 and 600 nm. In another preferred embodiment, the first pre-coating has a thickness between 600 and 850 nm. In another preferred embodiment, the first pre-coating has a thickness between 850 and 1200 nm. Indeed, without willing to be bound by any theory, it is believed that these thicknesses further improve the resistance to LME.

Preferably, an intermediate pre-coating is present between the steel substrate and the first pre-coating, such intermediate layer comprising iron, nickel, chromium and optionally titanium. Without willing to be bound by any theory, it seems that the intermediate coating layer further improves the adhesion of the second pre-coating on the first pre-coating.

In a preferred embodiment, the intermediate layer comprises at least 8% by weight nickel and at least 10% by weight chromium, the rest being iron. For example, the layer of metal coating is 316L stainless steel including 16-18% by weight Cr and 10-14% by weight Ni, the balance being Fe.

In another preferred embodiment, the intermediate layer comprises Fe, Ni, Cr and Ti wherein the amount of Ti is above or equal to 5 wt. % and wherein the following equation is satisfied: 8 wt. %<Cr+Ti<40 wt. %, the balance being Fe and Ni, such intermediate coating layer being directly topped by a coating layer being an anticorrosion metallic coating.

The thickness of the intermediate pre-coating, when present, is of 2 to 30 nm. Indeed, without willing to be bound by any theory, it is believed that this range of thickness allows for an improvement of the adhesion of the second pre-coating.

In another preferred embodiment, the zinc-based coating comprises 0.01-8.0% Al, optionally 0.2-8.0% Mg, the remainder being Zn. For example, the zinc based coating comprises 1.2 wt. % of Al and 1.2 wt. % of Mg or 3.7 wt. % of Al and 3 wt. % of Mg. More preferably, the zinc-based coating comprises between 0.10 and 0.40% by weight of Al, the balance being Zn.

Preferably, the steel substrate has the following chemical composition in weight percent:

$$0.05 \leq C \leq 0.4\%,$$

$$0.5 \leq Mn \leq 30.0\%,$$

$$0.05 \leq Si \leq 3.0\%,$$

and on a purely optional basis, one or more elements such as $$Al \leq 2.0\%,$$

$$P < 0.1\%,$$

$$Nb \leq 0.5\%,$$

$$B \leq 0.005\%,$$

$$Cr \leq 2.0\%,$$

$$Mo \leq 0.50\%,$$

$$Ni \leq 1.0\%,$$

$$V \leq 0.50\%,$$

$$Ti \leq 0.5\%,$$

the remainder of the composition making up of iron and inevitable impurities resulting from the elaboration. More preferably, the amount of Mn is the steel substrate is below or equal to 10 wt. %, advantageously below or equal 6 wt % or even better below 3.5 wt %.

FIG. 1 illustrates a pre-coated steel substrate according to the present invention. In this Example, a steel sheet 1, containing above 0.05 wt. % of Si, the steel surface being topped by a first pre-coating of titanium 2 having a thickness of 40 nm to 1200 nm and a second pre-coating of zinc 3. An optional intermediate coating 102 is shown schematically.

The invention also relates to a method for the manufacture of the coated steel substrate according to the present invention, comprising the successive following steps:

A. The provision of a steel substrate,

B. Optionally, the surface preparation of the steel substrate,

C. The deposition of the first pre-coating,

D. Optionally, the deposition of the intermediate pre-coating,

E. The deposition of the second pre-coating.

Preferably, in step B), the surface preparation is performed by etching, or pickling. It seems that this step allows for the cleaning of the steel substrate leading to the improvement of the adhesion of the first pre-coating.

Preferably, in steps C) and D), the deposition of first and intermediate pre-coating independently from each other is performed by physical vacuum deposition. More preferably, the deposition of first and intermediate pre-coatings independently from each other is performed by magnetron cathode pulverization process or jet vapor deposition process.

Advantageously, in step E), the deposition of the second pre-coating is performed by a hot-dip coating, by electrodeposition process or by vacuum deposition.

The invention further relates to a method for the manufacture of an assembly comprising the following successive steps:

I. The provision of at least two metallic substrates wherein at least one metallic substrate is the pre-coated steel substrate according to the present invention and II. The welding of the at least two metallic substrates.

Preferably, in step II), the welding is performed by spot welding, arc welding or laser welding.

With the method according to the present invention, it is possible to obtain an assembly of at least two metallic substrates welded together through a welded joint wherein the at least one metallic substrate is such that the steel substrate is topped by a coating comprising iron, $Fe_2TiSi$ compounds, the balance being zinc, said coating being covered by a layer comprising titanium oxides. The at least one metallic substrate originates from the pre-coated steel substrate according to the present invention.

Without willing to be bound by any theory, it is believed that $Fe_2TiSi$ compounds precipitates in the liquid Zn of the coating during welding, promoting an intense steel dissolution that prevents the zinc from penetrating into the steel grain boundaries. Moreover, it seems that a part of the first pre-coating layer comprising titanium migrates on the top of the zinc-based coating and oxidizes during the welding. The assembly according to the present invention has thus a high resistance to LME.

Figure 2:
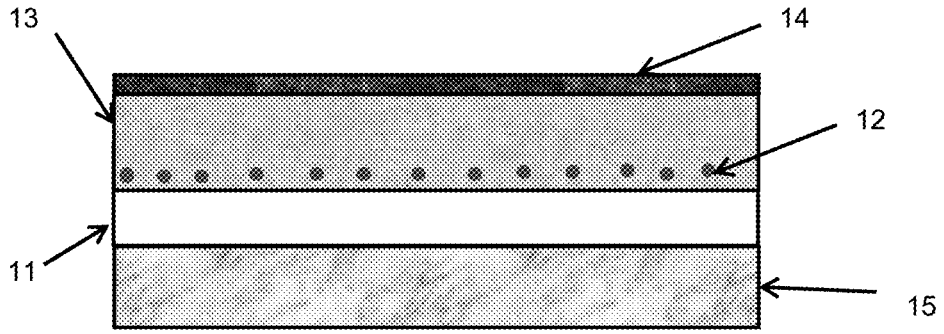

FIG. 2 illustrates a welded joint of an assembly of two metallic substrates wherein one metallic substrate is a steel sheet 11, topped by a first coating comprising iron, $Fe_2TiSiz$ compounds 12, z being from 0.01 to 0.8 and being expressed in atomic ratio, the balance being zinc 13 and a second coating comprising titanium oxides 14. In this Example, the second metallic substrate 15 is a bare steel sheet.

In one embodiment, the steel substrate does not comprise internal oxides of alloying elements of the steel.

In another preferred embodiment, the steel substrate comprises internal oxides of alloying elements of the steel. Preferably, the steel substrate comprises internal oxides of alloying elements comprise silicon oxides, manganese oxides, chromium oxides, aluminum oxides or a mixture thereof.

Preferably, the second metallic substrate is a steel substrate or an aluminum substrate. Preferably, the second metallic substrate is a pre-coated steel substrate according to the present invention.

Advantageously, the assembly comprises a third metallic substrate. Preferably, the third metallic substrate is a steel substrate or an aluminum substrate. Preferably, the third metallic substrate is a pre-coated steel substrate according to the present invention.

Finally, the use of an assembly obtainable from the method according to the present invention for the manufacture of parts of vehicle.

With a view to highlight the enhanced performance obtained through using the assemblies according to the invention, some concrete examples of embodiments will be detailed in comparison with assemblies based on the prior art.

EXAMPLES

For the Trials, two steel sheets having the chemical composition in weight percent disclosed in Table 1 were used:

| Steel Sheets | C | Mn | Si | Al | S | P | Cr | Nb | Cu | Ni | Ti | B | Fe |
|---|---|---|---|---|---|---|---|---|---|---|---|---|---|
| 1 | 0.21 | 1.65 | 1.65 | 0.042 | 0.001 | 0.013 | 0.026 | 0.001 | 0.008 | 0.011 | 0.008 | 0.006 | Balance |
| 2 | <0.002 | 0.11 | 0.007 | 0.050 | 0.008 | 0.010 | 0.020 | <0.002 | 0.018 | 0.021 | 0.054 | <0.0003 | Balance |
| 3 | 0.19 | 2.50 | 1.70 | 0.048 | 0.002 | 0.011 | 0.024 | 0.001 | 0.009 | 0.012 | 0.009 | 0.005 | Balance |

Example 1: Critical LME Elongation

For Trial 1, a first pre-coating of Titanium having a thickness of 900 nm was deposited by magnetron sputtering on a steel sheet having the composition 1. Then, an intermediate pre-coating layer being a stainless steel 316L was deposited on titanium. The thickness of the intermediate layer was of 10 nm. Finally, a second pre-coating layer being a zinc coating was deposited by jet vapor deposition. The second pre-coating layer thickness was of 7 μm. Trial 4 was made according to the same procedure on a steel sheet having the composition 3.

For Trial 2, a zinc coating having a thickness of 7 μm was deposited on steel sheet 1 by electrodeposition. Trial 5 was made according to the same procedure a steel sheet having the composition 3.

Trial 3 is a bare steel sheet 1.

| Trials | Steel | 1st coating | Intermediate coating | 2nd coating |
|---|---|---|---|---|
| 1* | 1 | Ti | FeNiCr (Stainless steel 316L) | Zn |
| 2 | 1 | Zn | — | — |
| 3 | 1 | — | — | — |
| 4* | 3 | Ti | FeNiCr (Stainless steel 316L) | Zn |
| 5 | 3 | Zn | — | — |

*according to the present invention

Then, Trials 1 to 3 were heated from ambient temperature to 800° C., 850° C. and 900° C. at a heating rate of 1000° C. per second using a Gleeble device. A tensile displacement was applied on each tensile specimen until fracture. The strain rate was of 3 mm per second. Tensile forces and displacement were recorded and the elongation at fracture could be determined from these stress-strain curves. This elongation at fracture represents the so-called Critical LME Elongation. The higher the critical LME strain, the more the Trial is resistant to LME. The methodology is also explained in the publication called «*Critical LME Elongation: Un essai Gleeble pour évaluer la sensibilité au LME d'un acier revêtu soudé par points*», Journées Annuelles SF2M 2017, 23-25 Oct. 2017, JA0104, ArcelorMittal Research Maizières-lès-Metz.

Results are gathered in the following Table 1.

| Trials | Temperature (° C.) | Critical LME Elongation (%) |
|---|---|---|
| 1* | 800 | 46 |
| | 850 | 38 |
| | 900 | 38 |
| 2 | 800 | 7 |
| | 850 | 13 |
| | 900 | 5 |
| 3 | 800 | 48 |
| | 850 | 49 |
| | 900 | 40 |

*according to the present invention

Results shown that Trial 1 has an improved resistance to LME compared to Trial 2. Trial 1 and Trial 3 have the same resistance to LME.

Example 2: Three Sheets Stack Up

The sensitivity to LME of different assemblies was evaluated by resistance spot welding method. To this purpose, for each Trial, three steel sheets were welded together by resistance spot welding.

Trial 6 was an assembly of Trial 1 with two galvanized steel sheets having the composition 2.

Trial 7 was an assembly of Trial 2 with two galvanized steel sheets having the composition 2.

Trial 8 was an assembly of Trial 4 with two galvanized steel sheets having the composition 2.

Trial 9 was an assembly of Trial 5 with two galvanized steel sheets having the composition 2.

The type of the welding electrode was F1 with a face diameter of 6 mm; the clamping force of the electrode was of 450 daN. The welding cycle was reported in Table 2:

| Weld time | Current (Hz) | Welding time (ms) | Cool time (ms) |
|---|---|---|---|
| Cycle | 50 | 380 | 260 |

Each trial was reproduced 10 times in order to produce 10 spot welds at a current level defined as the upper welding limit of the current range: Imax, Imax comprised between 0.9 and 1.1*$I_{exp}$, $I_{exp}$ being the intensity beyond which expulsion appears during welding, $I_{exp}$ was determined according to ISO standard 18278-2.

The highest crack length in the spot-welded joint was then evaluated after cross-sectioning through the surface crack and using an optical microscope as reported in the following Table 3. The LME crack resistance behavior was evaluated with respect to the 10 spot welds (representing 100% in total).

| Trials | No cracks | 0 < Crack < 100 μm | 100 μm < Crack < 200 μm | Crack > 0.5*assembly thickness (assembly thickness = 1.00 mm) |
|---|---|---|---|---|
| Trial 6* | 70% | 20% | 10% | — |
| Trial 7 | 30% | 10% | 30% | 30% |
| Trial 8* | 20% | 50% | 20% | 10% |
| Trial 9 | — | 30% | 30% | 40% |

*according to the present invention.

Trials 6 and 8 according to the present invention show an excellent resistance to LME as compared to Trials 7 and 9.

What is claimed is:

1. A pre-coated steel substrate comprising:

a steel substrate comprising above 0.05 wt. % of Si;

a first pre-coating on the steel substrate, the first pre-coating consisting of titanium and having a thickness of 40 nm to 1200 nm;

a zinc-based second pre-coating; and an intermediate pre-coating layer located between the first pre-coating and the zinc-based second precoating, the intermediate pre-coating layer comprising at least 8% by weight nickel and at least 10% by weight chromium, a remainder being iron; the intermediate pre-coating layer having a thickness between 2 and 30 nm.

2. The pre-coated steel substrate as recited in claim 1 further comprising an intermediate pre-coating layer comprising Fe, Ni, Cr and Ti wherein the amount of Ti is above or equal to 5 wt. % and wherein the following equation is satisfied: 8 wt. %<Cr+Ti<40 wt. %, a remainder being Fe and Ni, the intermediate pre-coating layer having a thickness between 2 and 30 nm.

3. The pre-coated steel substrate as recited in claim 1 wherein the thickness of first pre-coating is between 40 and 80 nm.

4. The pre-coated steel substrate as recited in claim 1 wherein the thickness of first pre-coating is between 80 and 150 nm.

5. The pre-coated steel substrate as recited in claim 1 wherein the thickness of first pre-coating is between 150 and 250 nm.

6. The pre-coated steel substrate as recited in claim 1 wherein the thickness of first pre-coating is between 250 and 450 nm.

7. The pre-coated steel substrate as recited in claim 1 wherein the thickness of the first pre-coating is between 450 and 600 nm.

8. The pre-coated steel substrate as recited in claim 1 wherein the thickness of the first pre-coating is between 600 and 850 nm.

9. The pre-coated steel substrate as recited in claim 1 wherein the thickness of the first pre-coating is between 850 and 1200 nm.

10. The pre-coated steel substrate as recited in claim 1 wherein the intermediate pre-coating layer includes stainless steel containing between 10 and 13% by weight nickel, between 16 and 18% by weight chromium, the remainder being iron.

11. The pre-coated steel substrate as recited in claim 1 wherein the second pre-coating includes from 0.01 to 8.0% Al, optionally 0.2-8.0% Mg, a remainder being Zn.

12. The pre-coated steel substrate as recited in claim 1 wherein the second pre-coating includes optionally 0.10 and 0.40 wt. % of Al, a remainder being zinc.

13. The pre-coated steel substrate as recited in claim 1 wherein the steel substrate has the following composition in weight percent:

$$0.05 \le C \le 0.4\%,$$

$$0.5 \le Mn \le 30.0\%,$$

$$0.05 \le Si \le 3.0\%,$$

and optionally one or more of the following elements:

$$Al \le 2.0\%,$$

$$P < 0.1\%,$$

$$Nb \le 0.5\%,$$

$$B \le 0.005\%,$$

$$Cr \le 2.0\%,$$

$$Mo \le 0.50\%,$$

$$Ni \le 1.0\%,$$

$$V \le 0.50\%,$$

$$Ti \le 0.5\%,$$

a remainder of the composition being iron and inevitable impurities resulting from processing.

14. A method for the manufacture of the pre-coated steel substrate as recited in claim 1, the method comprising the successive following steps:

A. providing the steel substrate;

B. optionally, a surface preparing the steel substrate,

C. depositing the first pre-coating layer;

D. depositing an intermediate pre-coating layer; and

E. depositing the second pre-coating layer.

15. The method as recited in claim 14 wherein step D) is performed and in steps C) and D), the deposition of first pre-coating layer and intermediate pre-coating layer are performed independently from each other by physical vacuum deposition.

16. The method as recited in claim 14 wherein step D) is performed and in steps C) and D), the deposition of first pre-coating and intermediate pre-coating is performed independently from each other by magnetron cathode pulverization process or jet vapor deposition process.

17. A method for the manufacture of an assembly of at least two metallic substrates comprising the following successive steps:

providing at least two metallic substrates wherein at least one metallic substrate is the pre-coated steel substrate as recited in claim 1; and welding of the at least two metallic substrates.

18. The method as recited in claim 17 wherein the welding is performed by spot welding or arc welding.

19. An assembly obtainable from the method as recited in claim 17, the assembly comprising: least two metallic substrates welded together through a welded joint wherein the at least one metallic substrate is such that the steel substrate is topped by a coating comprising iron, $Fe_2TiSi_z$ compounds, z being from 0.01 to 0.8 and being expressed in atomic ratio, a remainder being zinc, such coating being covered by a layer comprising titanium oxides.

20. The assembly as recited in claim 19 wherein the steel substrate comprises internal oxides of alloying elements of the steel.

21. The assembly as recited in claim 20 wherein the internal oxides of alloying elements includes silicon oxides, manganese oxides, chromium oxides, aluminum oxides or a mixture thereof.

22. The assembly as recited in claim 19 wherein the second metallic substrate is a steel substrate or an aluminum substrate.

23. The assembly as recited in claim 19 wherein the second metallic substrate is a further pre-coated steel substrate including a further steel substrate comprising above 0.05 wt. % of Si; a further first pre-coating on the steel substrate, the first pre-coating including titanium and having a thickness of 40 nm to 1200 nm; and a further zinc-based second pre-coating.

24. A method for manufacturing parts of a vehicle comprising employing the assembly as recited in claim 19.

25. A method for manufacturing parts of a vehicle comprising performing the method as recited in claim 17.

* * * * *